US008156599B2

(12) United States Patent
Waguespack et al.

(10) Patent No.: US 8,156,599 B2
(45) Date of Patent: Apr. 17, 2012

(54) ORAL CARE IMPLEMENT HAVING A HEAD INSERT

(75) Inventors: Kenneth Waguespack, North Brunswick, NJ (US); Robert Moskovich, East Brunswick, NJ (US); Bruce Russell, Howell, NJ (US)

(73) Assignee: Colgate-Palmolive Company, New York, NY (US)

( * ) Notice: Subject to any disclaimer, the term of this patent is extended or adjusted under 35 U.S.C. 154(b) by 1195 days.

(21) Appl. No.: 11/866,590

(22) Filed: Oct. 3, 2007

(65) Prior Publication Data

US 2009/0091178 A1 Apr. 9, 2009

(51) Int. Cl.
*A46B 9/04* (2006.01)
*A46B 11/00* (2006.01)

(52) U.S. Cl. ..... 15/104.94; 15/106; 15/167.1; 15/176.5

(58) Field of Classification Search ..... 15/167.1, 15/176.4, 176.5, 176.6, 105, 104.94, 106; 132/309, 316; 433/30, 31
See application file for complete search history.

(56) References Cited

U.S. PATENT DOCUMENTS

| | | | | |
|---|---|---|---|---|
| 1,800,993 | A * | 4/1931 | Funk | 15/176.5 |
| 2,525,181 | A * | 10/1950 | Ransdell | 433/30 |
| 2,631,320 | A | 3/1953 | Bressler | |
| 2,650,383 | A | 9/1953 | Bressler | |
| 3,300,859 | A * | 1/1967 | Sanden | 433/30 |
| 3,589,823 | A | 6/1971 | Hendrickson | |
| 4,240,452 | A | 12/1980 | Jean | |
| 4,291,431 | A | 9/1981 | Lewis, Jr. | |
| 4,592,726 | A * | 6/1986 | Brilliant | 433/31 |
| 4,694,844 | A | 9/1987 | Berl | |
| 4,936,633 | A | 6/1990 | Weihrauch | |
| 5,242,235 | A | 9/1993 | Li | |
| 5,350,219 | A | 9/1994 | Shou-Jen | |
| 5,366,310 | A * | 11/1994 | Armelles Flors | 401/132 |
| 5,799,356 | A | 9/1998 | Kawashima | |
| 5,875,510 | A | 3/1999 | Lamond et al. | |

(Continued)

FOREIGN PATENT DOCUMENTS

DE 35 29 953 * 3/1987

(Continued)

OTHER PUBLICATIONS

International Search Report PCT/US2008/078353 Dated Dec. 23, 2008.

*Primary Examiner* — Randall Chin
(74) *Attorney, Agent, or Firm* — Amy M. Fernandez

(57) ABSTRACT

An oral care implement is provided with a head platform having a plurality of faces and an insert retention space formed therebetween. The oral care implement can have an insert disposed within the insert retention space. The oral care implement can further include a transparent or translucent support member on one of the faces and a reflective insert within the insert retention space. The oral care implement can include a plurality of support members on the plurality of faces from which cleaning elements extend. The oral care implement can further include a fluid-permeable and/or air-permeable support member on one of the faces and an insert containing a fluid-permeable and/or air-permeable agent. The oral care implement can be formed by affixing a first AFT-tufted carrier plate to a first face of the head platform and affixing a second AFT-tufted carrier plate to the second face of the head platform.

11 Claims, 14 Drawing Sheets

U.S. PATENT DOCUMENTS

| | | | |
|---|---|---|---|
| 5,964,508 | A | 10/1999 | Maurer |
| 6,115,870 | A | 9/2000 | Solanki et al. |
| 6,131,228 | A | 10/2000 | Chen et al. |
| 6,192,544 | B1 | 2/2001 | Persidsky et al. |
| 6,290,303 | B1 | 9/2001 | Boucherie |
| 6,702,394 | B2 | 3/2004 | Boucherie |
| 6,752,627 | B2 | 6/2004 | Lin |
| 6,779,851 | B2 | 8/2004 | Bouchiere et al. |
| 6,792,642 | B2 | 9/2004 | Wagstaff |
| 6,957,468 | B2 | 10/2005 | Driesen et al. |
| 6,988,777 | B2 | 1/2006 | Pfenniger et al. |
| 7,143,462 | B2 | 12/2006 | Hohlbein |
| 7,162,767 | B2 | 1/2007 | Pfenniger et al. |
| 2001/0050507 | A1 | 12/2001 | Boucherie |
| 2002/0124864 | A1 | 9/2002 | Gross et al. |
| 2002/0166188 | A1 | 11/2002 | Driesen et al. |
| 2003/0009837 | A1 | 1/2003 | Cann |
| 2003/0132661 | A1 | 7/2003 | Sato et al. |
| 2004/0087882 | A1 | 5/2004 | Roberts et al. |
| 2004/0255416 | A1 | 12/2004 | Hohlbein |
| 2005/0000043 | A1 | 1/2005 | Chan et al. |
| 2005/0166344 | A1 | 8/2005 | Hohlbein et al. |
| 2005/0193510 | A1 | 9/2005 | Kemp |
| 2006/0026784 | A1 | 2/2006 | Moskovich et al. |
| 2006/0085932 | A1 | 4/2006 | Santos |
| 2006/0230652 | A1 | 10/2006 | Little |
| 2006/0272113 | A1 | 12/2006 | Cato et al. |
| 2007/0094824 | A1 | 5/2007 | Pfenniger et al. |
| 2007/0101525 | A1 | 5/2007 | Hohlbein |
| 2007/0202467 | A1 | 8/2007 | Hohlbein |
| 2008/0014010 | A1 * | 1/2008 | Bartschi et al. ..... 401/146 |

FOREIGN PATENT DOCUMENTS

| | | | |
|---|---|---|---|
| DE | 3620846 | | 12/1987 |
| DE | 20006311 | U1 | 8/2001 |
| EP | 0 405 204 | | 1/1991 |
| EP | 0 567 672 | | 11/1993 |
| EP | 0 704 179 | | 3/1996 |
| EP | 0 972 694 | | 1/2000 |
| EP | 1 639 913 | A | 3/2006 |
| WO | WO 94/22346 | | 10/1994 |
| WO | WO 0180686 | | 11/2001 |
| WO | 02058508 | A | 8/2002 |
| WO | 2006012956 | A | 2/2006 |

* cited by examiner

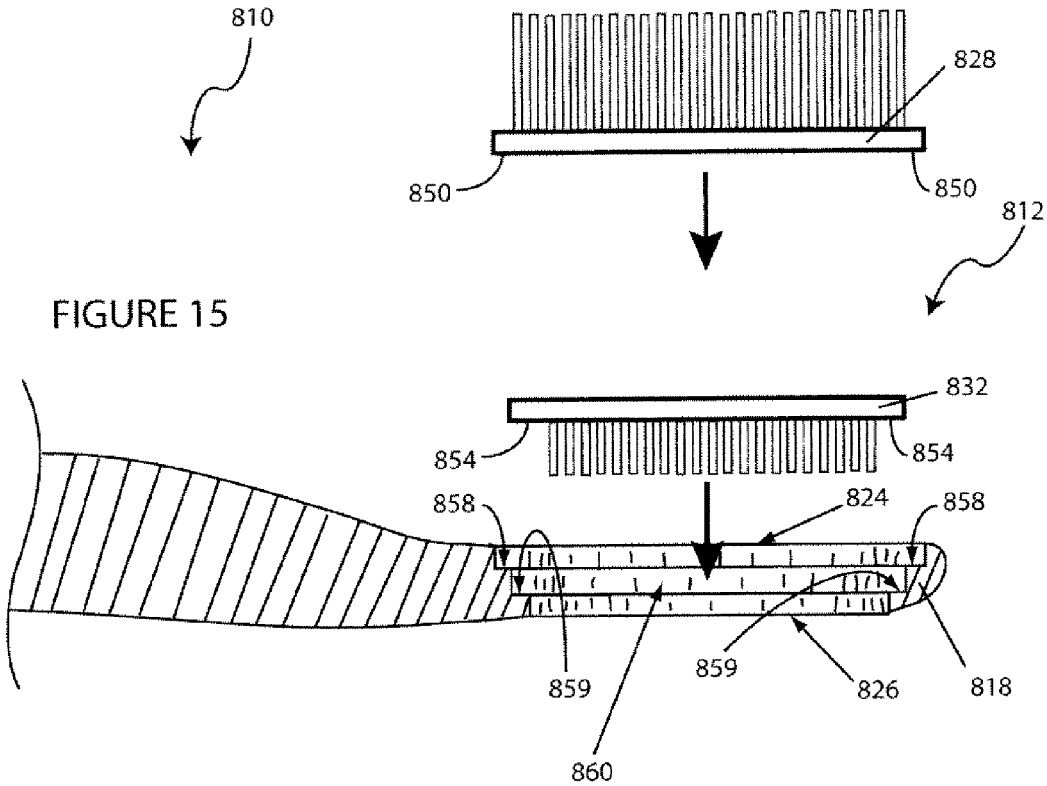
FIGURE 15
FIGURE 16
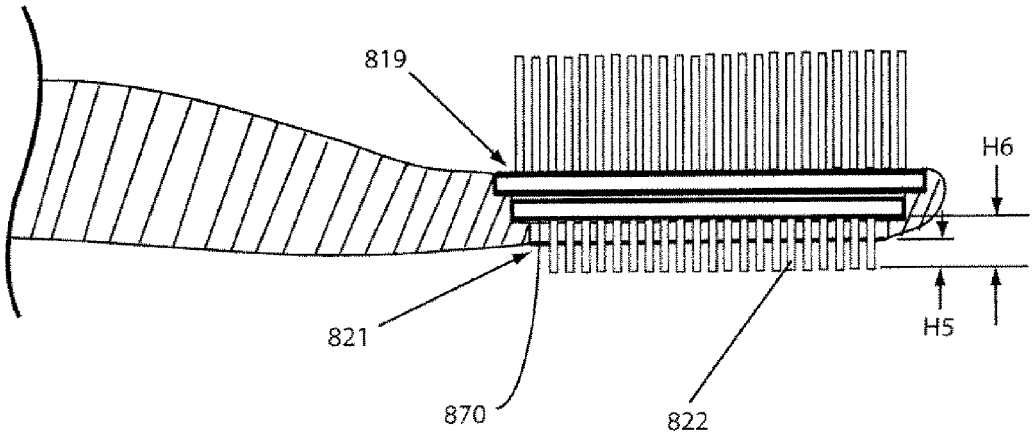

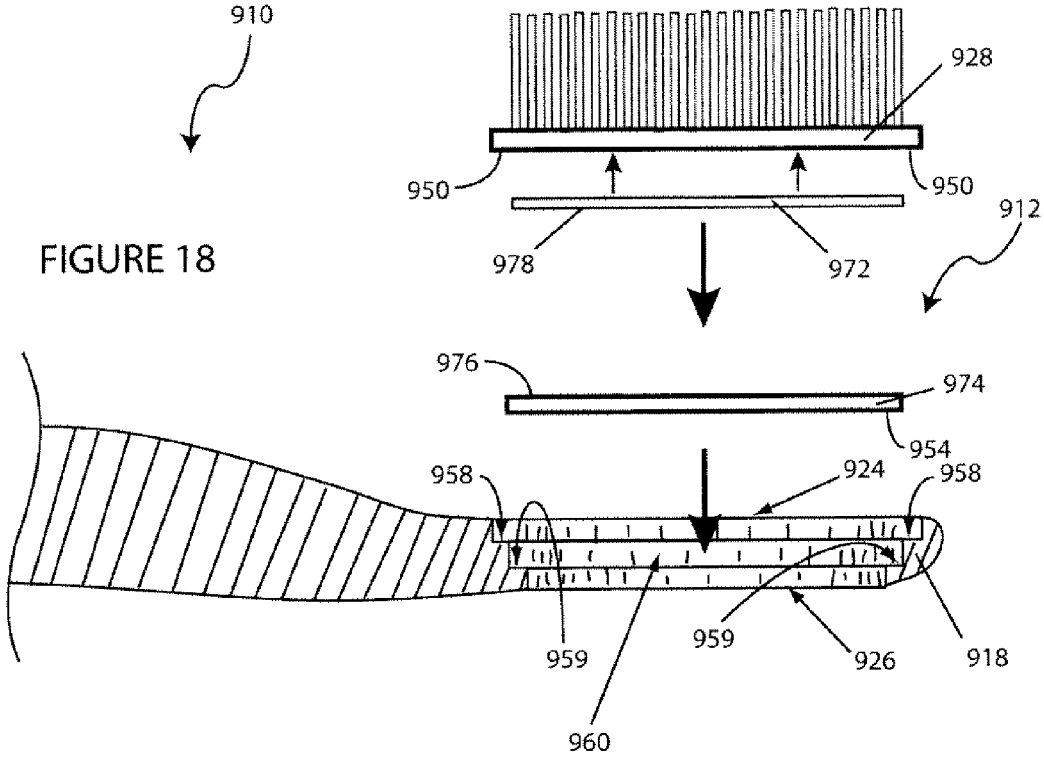
FIGURE 18
FIGURE 19
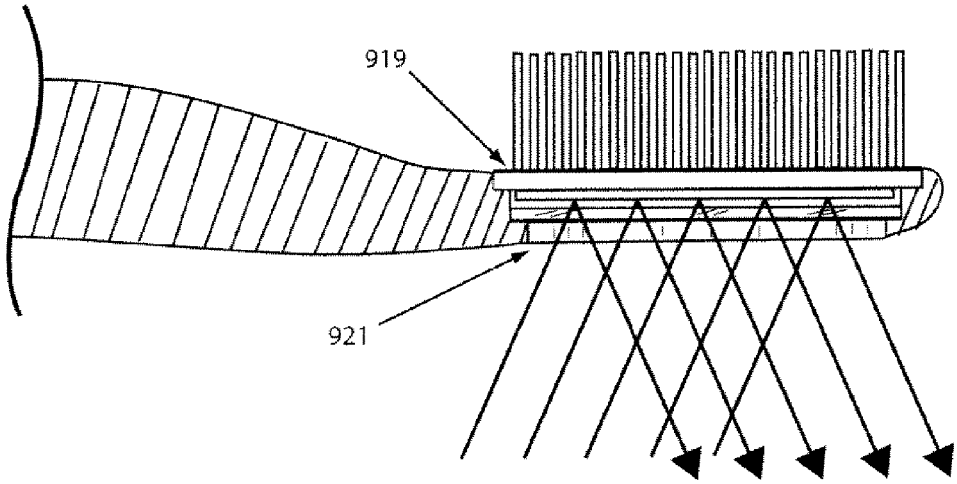

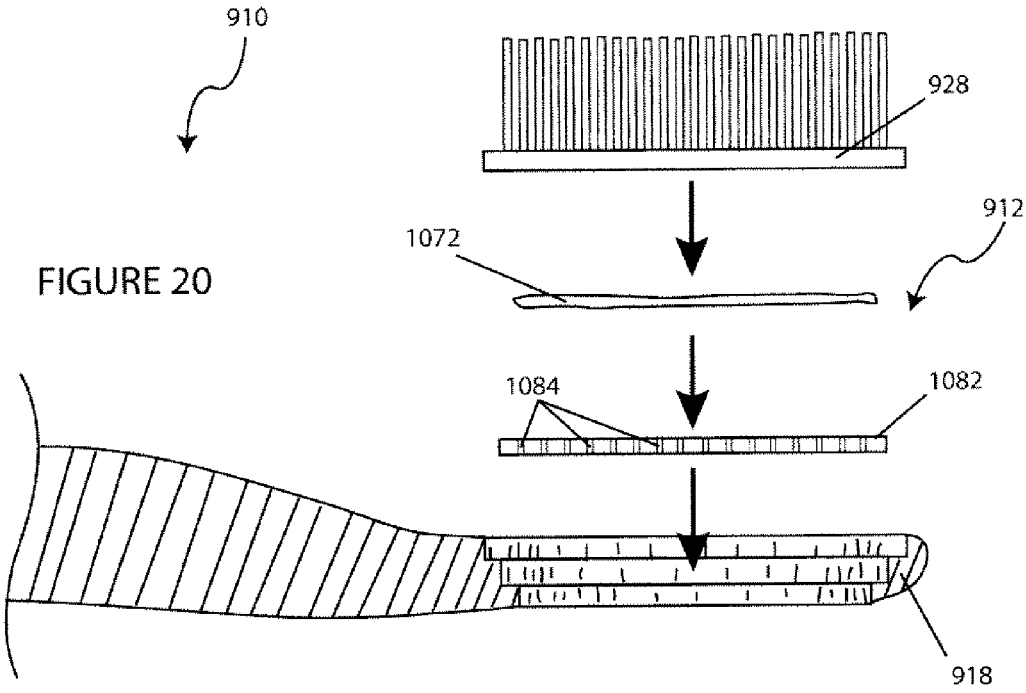
FIGURE 20
FIGURE 21
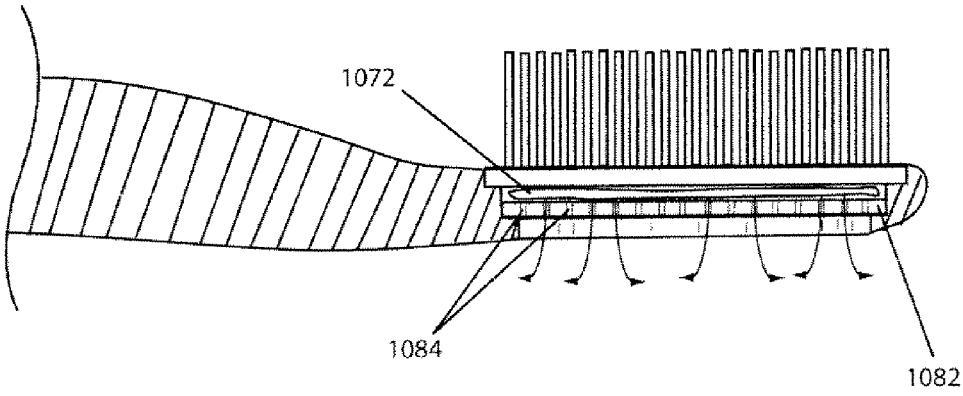

ORAL CARE IMPLEMENT HAVING A HEAD INSERT

FIELD OF THE INVENTION

The present invention is directed to an oral care implement having a supplemental feature incorporated within and/or at the back of the head.

BACKGROUND OF THE INVENTION

Oral care implements, particularly toothbrushes, are typically used by applying toothpaste to a bristled section on a front face of the oral care implement followed by brushing regions of the oral cavity, e.g., the teeth, tongue, and/or gums. FIG. 1 schematically illustrates a conventional toothbrush 10, which has a head 12 and a handle 14. As shown, the head has bristles 16 extending from a front face of its head platform 18. The overall thickness H1 of the head, including the bristles, ranges from 15 mm to 20 mm to permit comfortable use of the toothbrush by most adults.

Some toothbrushes have a tongue cleaner on a second face that is opposite to the first face. This configuration permits the user to use a single device for cleaning their teeth, as well as their tongue, by rotating the toothbrush as needed to change the active face. FIG. 2 schematically illustrates a conventional combination toothbrush/tongue cleaner device 30, which is generally the same as toothbrush 10 except that it includes a tongue cleaner 20 on its rear face. The overall thickness H2 of the head ranges from 16 mm to 20 mm to accommodate the tongue cleaner and to permit comfortable use of the device by most adults. As shown in FIG. 2, the head platform of conventional toothbrushes has a thickness T of 5 mm to 8 mm.

There is a continuing need for alternative oral care implements that can provide multiple cleaning functions in a single device. Further, there is a need for alternative oral care implements that can simultaneously perform multiple functions and comfortably fits within a user's mouth.

BRIEF SUMMARY OF THE INVENTION

This summary is provided to introduce a selection of concepts in a simplified form that are further described below in the Detailed Description. This summary is not intended to identify key features or essential features of the claimed subject matter.

An oral care implement according to aspects of the invention can include a head platform having a plurality of faces and an insert retention space formed therebetween. The oral care implement can have an insert disposed within the insert retention space. The oral care implement can further include a transparent or translucent support member on one of the faces and a reflective insert within the insert retention space.

An oral care implement according to aspects of the invention can include a plurality of support members on a plurality of faces from which cleaning elements extend. The oral care implement can further include a fluid-permeable and/or air-permeable support member on one of the faces and an insert proximate the support member containing a fluid-permeable and/or air-permeable agent.

These and other aspects of the disclosure will be apparent upon consideration of the following detailed description of illustrative embodiments.

BRIEF DESCRIPTION OF THE DRAWINGS

FIG. 15. is an exploded cross-sectional view of the oral care implement of FIG. 14 taken along line 15-15.

FIG. 16 is an assembled cross-sectional view of the oral care implement of FIG. 14 taken along line 15-15.

FIG. 18 is an exploded cross-sectional view of the oral care implement of FIG. 17 taken along line 18-18.

FIG. 19 is an assembled cross-sectional view of the oral care implement of FIG. 17 taken along line 18-18.

FIG. 20 is an exploded cross-sectional view of the oral care implement of FIG. 17 taken along line 18-18 according to an alternate configuration.

FIG. 21 is an assembled cross-sectional view of the oral care implement of FIG. 20.

DETAILED DESCRIPTION OF THE INVENTION

The various aspects summarized previously may be embodied in various forms. The following description shows by way of illustration various combinations and configurations in which the aspects may be practiced. It is understood that the described aspects and/or embodiments are merely examples, and that other aspects and/or embodiments may be utilized and that structural and functional modifications may be made without departing from the scope of the present disclosure.

Figure 1:
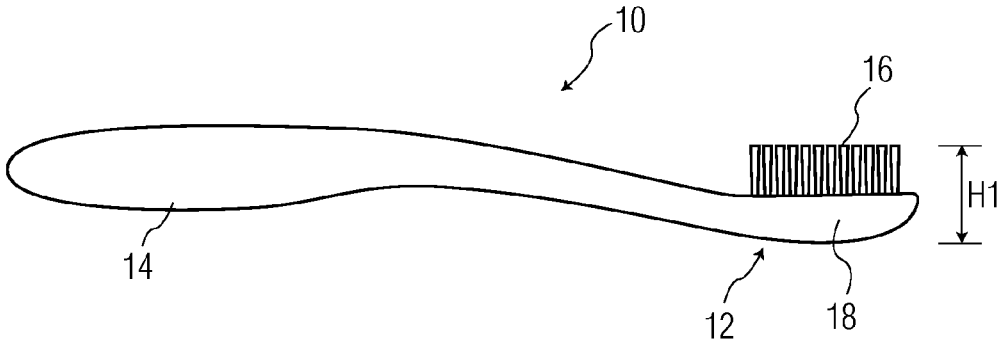
FIG. 1 PRIOR ART
FIGS. 1 and 2 are side views of toothbrushes known in the art.
Figure 3:
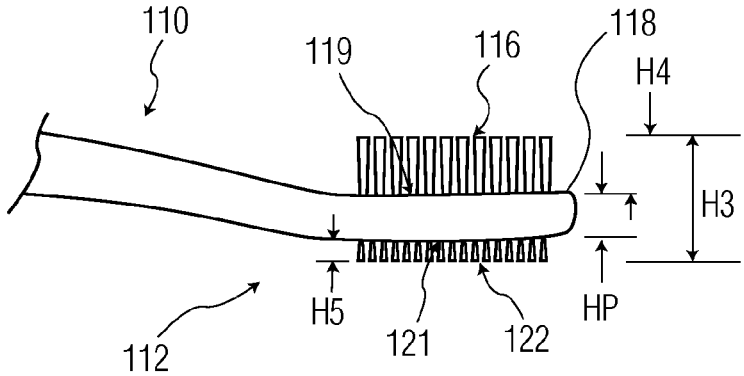
FIG. 3 is a side view of a head portion of an oral care implement according to one or more aspects of an illustrative embodiment.

FIG. 3 schematically illustrates a head 112 of an oral care implement 110, which may be placed on the handle of a conventional toothbrush, such as handle 14 of conventional toothbrush 10 shown in FIG. 1. Head 112 generally includes a head platform 118 having a first face 119, a second face 121, a first set of cleaning elements 116 and a second set of cleaning elements 122. The first set of cleaning elements extends outwardly from the first face and the second set of cleaning elements extends outwardly from the second face.

In the configuration shown in FIG. 3, head platform 118 includes only two faces from which cleaning elements extend. It is understood that the head platform could include more than two faces from which cleaning elements extend. Further, it is understood that the faces having cleaning elements could be arranged in various configurations that may or may not be opposite to another face. For instance, another configuration of head 112 could include a head platform with three faces from which cleaning elements extend that are arranged in a generally triangular arrangement. However, as discussed further below, the configuration of head platform 118 with opposite faces, a relatively thin platform height HP, and a relatively thin overall height H3 provides various advantages during use.

Cleaning elements 116 and 122 as shown may extend perpendicularly from their respective faces 119 and 121. Further, the cleaning elements may extend in opposite directions from each other. However, it is understood that the cleaning elements may be configured in other orientations. For example, the cleaning elements can be angled with respect to their face and with respect to each other. Cleaning elements 116 and 122 may include a variety of oral cleaning elements, such as tooth cleaning elements, which can be used for wiping, cleaning and massaging the user's teeth and gums, and soft tissue cleaning elements, which can be used for scrubbing, scraping and massaging the user's tongue, inside of cheeks, etc. Any suitable form of oral cleaning elements may be used. However, as discussed further below, it is preferable to include filament bristles with both the tooth cleaning elements and the soft tissue cleaning elements. The term "oral cleaning elements" is used in a generic sense and generally refers to filament bristles, elastomeric fingers or walls that have any desirable shape, tissue engaging projections such ridges and nubs, etc. As used herein, a "nub" is generally meant to include a column-like protrusion (without limitation to the cross-sectional shape of the protrusion), which is upstanding from a base surface. Preferably, cleaning elements 116 and 122 include filament bristles, either alone or in combination with other types of oral cleaning elements. Cleaning elements 116 are generally tooth cleaning elements, which may include elastomeric fingers or walls along with filament bristles. As such, cleaning elements 116 have a height H4 from 10 mm to 13 mm, which provide sufficient length and flexibility for engaging gaps and crevices between the user's teeth and between their teeth and gums and for brushing or wiping away particles engaged by the cleaning elements.

Cleaning elements 122 are generally soft tissue cleaning elements, which may include tissue engaging projections, such as ridges and nubs, and/or elastomeric fingers or walls along with relatively short filament bristles. Such tissue engaging elements can help reduce a major source of bad breath and improve hygiene. Cleaning elements 122 have a height H5 from 1 mm to 6 mm and preferably from 1.5 mm to 4 mm.

Filament bristles having a height in the range of 1 mm to 6 mm and preferably in the range of 1.5 mm to 4 mm are relatively short in comparison to their column width, which preferably is in the range of 0.06 to 0.18 mm +/− to 0.02 mm for individual filaments and in the range of 1 mm to 2 mm +/−0.2 mm for individual bundles of bristles. As such, filament bristles of cleaning elements 122 have a relatively high column strength in comparison with filament bristles of tooth cleaning elements 116, which are longer and more flexible than tissue cleaning elements 122. Due to their thin diameter and their high column strength, the relatively short tissue cleaning elements and, in particular, the relatively short filament bristles are able to penetrate very well into the user's soft oral tissues.

In the configuration shown in FIG. 3, oral cleaning elements 122 are able to engage soft tissues within the user's mouth, such as the inside of their cheeks, while the user simultaneously cleans their teeth. Thus, more effective oral cleaning is provided by oral cleaning implement 110 than conventional toothbrush 10 or conventional combination toothbrush/tongue cleaner 30. This is true even though combination device 30 includes soft elastomeric tongue cleaning projections 20, which can penetrate a user's soft oral tissues, but do not penetrate as well as relatively short, thin filament bristles 122, and which fail to provide the brushing action of filament bristles 122.

In general, soft tissue cleaning elements 122 enable the removal of microflora and other debris from the tongue and other soft tissue surfaces within the mouth. The tongue, in particular, is prone to develop bacterial coatings that are known to harbor organisms and debris that can contribute to bad breath. These microfloras can be found in the recesses between the papillae on most of the tongue's upper surface as well as along other soft tissue surfaces in the user's mouth. When engaged or otherwise pulled against a tongue surface, for example, the filament bristles of tissue cleaning elements 122 can provide for gentle engagement with the soft tissue while reaching downward into the recesses of adjacent papillae of the tongue and while providing a brushing action within the recesses.

The columnar filament construction of the bristles also enables the soft tissue cleaning elements to follow the natural contours of the oral tissue surfaces, such as the tongue, cheeks, lips, and gums of a user. In addition, the filament bristles are able to flex as needed to traverse and clean the soft tissue surfaces in the mouth along they are moved. The flexibility of the filament bristle tissue cleaning elements, their small diameter, and their relatively high column strength allow them to effectively penetrate soft oral tissues and to engage and brush out microflora and other debris much better than other types of tissue cleaning elements.

Figure 2:
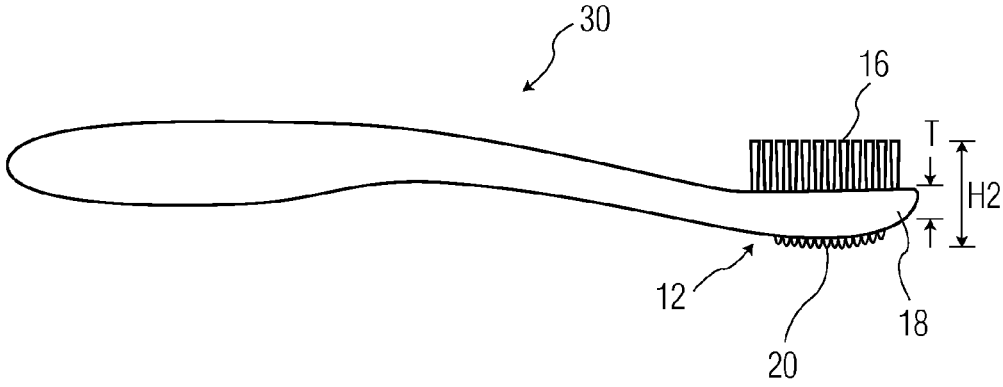
FIG. 2 PRIOR ART

Conventional combination toothbrush/tongue cleaner devices, such as device 30 shown in FIG. 2, have failed to provide filament bristles in tongue cleaner 20. This is because conventional techniques for affixing filament bristles to a toothbrush, such as the conventional method of stapling folded bristle bundles into a head, would require a much thicker head than would be comfortable for most adult users in order to accommodate bristles on opposite sides of the toothbrush. As such, conventional toothbrush/tongue cleaner devices include a pad of elastomeric tongue cleaning elements glued to the back of the toothbrush head, or a plurality of hard projections molded on the back of the toothbrush head. However, such conventional devices fail to provide filament bristle soft tissue cleaning elements 122 along with filament bristle tooth cleaning elements 116 on the head of the same device while having a head thickness small enough for comfortable use by an adult.

To further enhance the effectiveness of oral care implement device 110, device 110 can optionally include a vibratory device (not shown) to vibrate the oral care implement or a portion thereof, such as the head 112 or a portion thereof. The vibration-producing device can be used to vibrate tooth cleaning elements 116 and/or soft tissue cleaning elements 122.

A wide variety of vibratory devices can be used to produce vibrations over a wide range of frequencies to meet the needs of a particular application. Various types of vibratory devices are commercially available, such as transducers. One example of a vibratory device provides frequencies in the range of about 100 to 350 kHz. The vibration frequencies may be of different waveforms, including sinusoid, square, saw tooth and the like. Nevertheless, other values and waveforms are possible. A vibratory device may be located in head of the toothbrush or neck thereof. When activated, vibratory device is powered by battery (and controlled by electronics on circuit board or switching system) so as to induce vibrations in head of the toothbrush and thereby enhances teeth-cleaning action imparted by the tooth cleaning elements.

In alternate embodiments, a vibratory device may include a micro motor attached to a shaft, with the shaft coupled to an eccentric rotating about an axis parallel to the longitudinal axis of the toothbrush. In still other embodiments, a vibratory-producing device includes an eccentric that is driven by a micro motor in a translatory manner.

A switch, such as a button, toggle switch, rotating dial, or the like, can be provided for activating the vibratory device. A vibratory device often has a power source, such as a battery. Activating the switch can cause the vibration-producing device to operate for a user-defined interval (e.g., during the time that a button is depressed or a switch is in an engaged position), or alternatively can activate a timing circuit that causes the vibratory device to operate for a predetermined interval. If a timing circuit is used, the associated interval either may be preset or may be adjustable, e.g., by a user-activated rotating dial.

Figure 4:
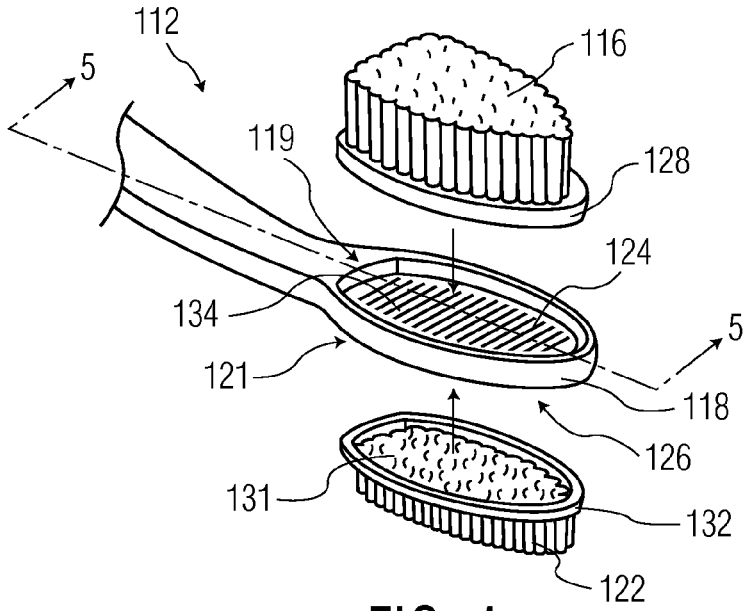
FIG. 4 is an exploded perspective view of the oral care implement head of FIG. 3.
Figure 5:
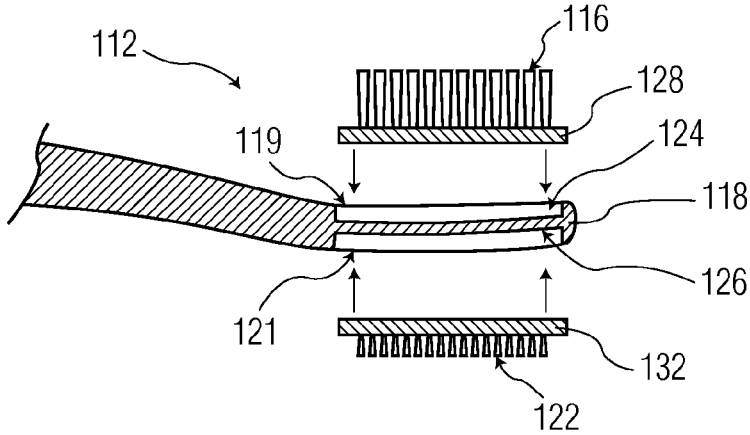
FIG. 5 is an exploded section view of the oral care implement head of FIG. 3 taken along line 5-5 of FIG. 4.
Figure 6:
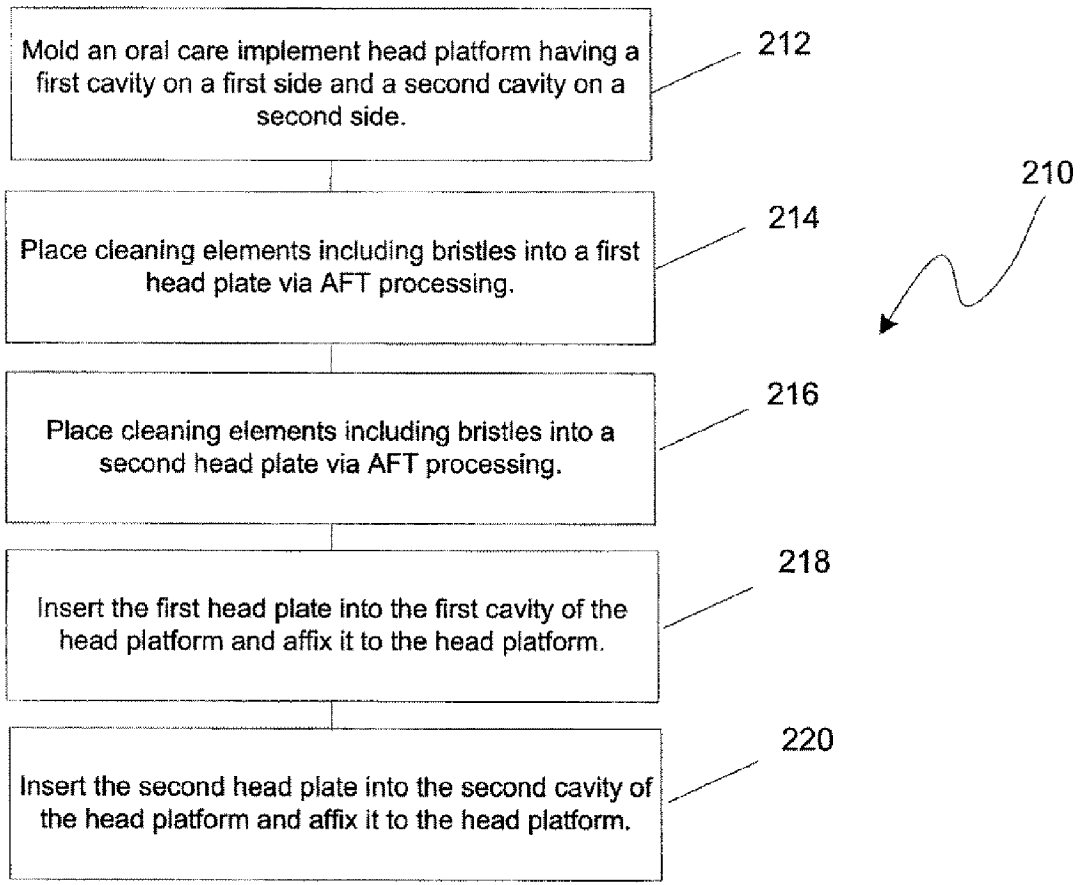
FIG. 6 illustrates a method for forming an oral care implement having a plurality of bristled heads according to one or more aspects of an illustrative embodiment.

FIGS. 4-6 illustrate a method 210 for forming an oral cleaning device, such as oral care implement 110, having a pair of faces that include filament bristles (i.e., tufted faces), which permits the head to have an overall thickness of 20 mm or less. As shown in FIGS. 4 and 5, method 210 can be practiced via anchor-free tufting (AFT) techniques. Accordingly, head 112 includes a first carrier plate 128 to which tooth cleaning elements 116 are affixed via AFT processing and a second carrier plate 132 to which oral cleaning elements 122 are affixed via APT processing. The carrier plates have a plurality of cutouts (not shown) through which clusters of bristle filaments 116, and optionally elastomeric cleaning elements 116, are guided. The rear ends of the bristle filaments are melted to affix them to their respective carrier plate. The melted portions form a base 131 that adheres to the carrier plate and bonds the bristle bundles to each other. If elastomeric cleaning elements are also provided, they can be melted along with the bristles or glued to the carrier plate.

The carrier plates 128 and 132 are relatively thin (e.g., 1 mm or less) and are received into corresponding recesses 124 and 126 formed in the faces 119 and 121 of the head platform 118. The carrier plates may be affixed to the head platform via appropriate methods such as ultrasonic welding, laser welding, hot air welding gluing, a snap-fit connection in combination with overmolding, or any other plastic joining technique. Other suitable plastic joining techniques will become readily apparent to those skilled in the art, given the benefit of this disclosure. Preferably, carrier plates 128 and 132 are affixed via ultrasonic welding to membrane 134 of the head platform, which provides a non-visible, high strength bond to the head platform at a relatively low manufacturing cost.

As illustrated in FIG. 6, a method 210 for forming such an oral cleaning device can include the step 212 of molding an oral care implement head platform 118 having a first cavity 124 on a first side and second cavity 126 on a second side. It can further include the steps 214 of guiding tooth cleaning elements 116 including bristles into cutouts of first carrier plate 128 via AFT processing and the step 216 of guiding soft tissue cleaning elements 122 including bristles into cutouts of second carrier plate 132 via AFT processing. The method also includes the step 218 of inserting the first carrier plate 128 into the first cavity 124 and affixing it to head platform 118 and the step 220 of inserting the second carrier plate 132 into the second cavity 126 and affixing it to head platform 118.

As noted above, the carrier plates are preferably affixed via ultrasonically welding them to the head platform, such as welding them to platform 134 of the head platform. However, they may be affixed via other methods, such as gluing them to the head platform or snap fitting them into the head platform and overmolding another material around portions of the head platform and the carrier plates. It is understood that the steps of method 210 may be performed in various orders and that many steps may be performed simultaneously. For instance, steps 214 and 216 can be sequentially in any order or can be performed simultaneously.

Figure 7:
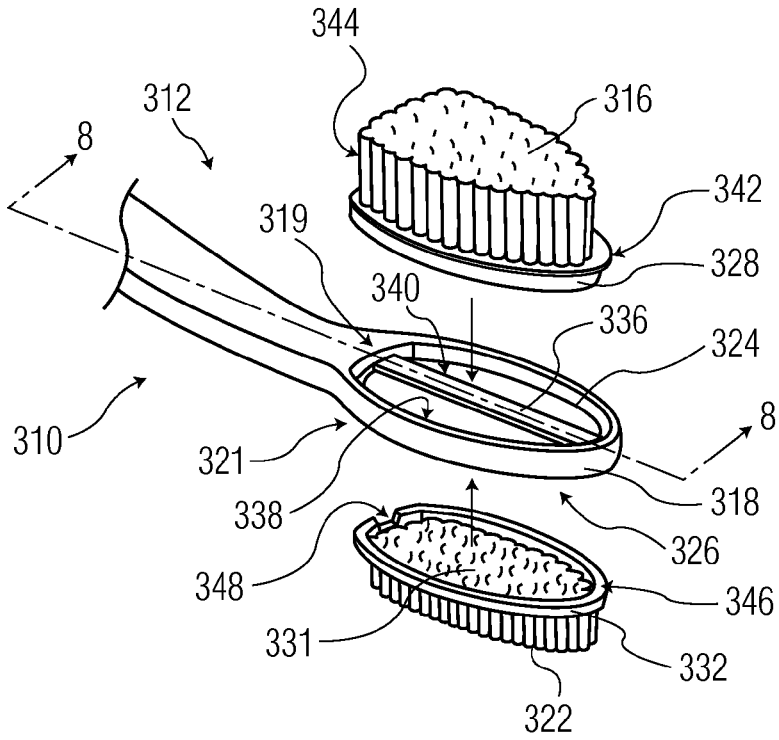
FIG. 7 is an exploded perspective view of an oral care implement head according to one or more aspects of an illustrative embodiment.
Figure 8:
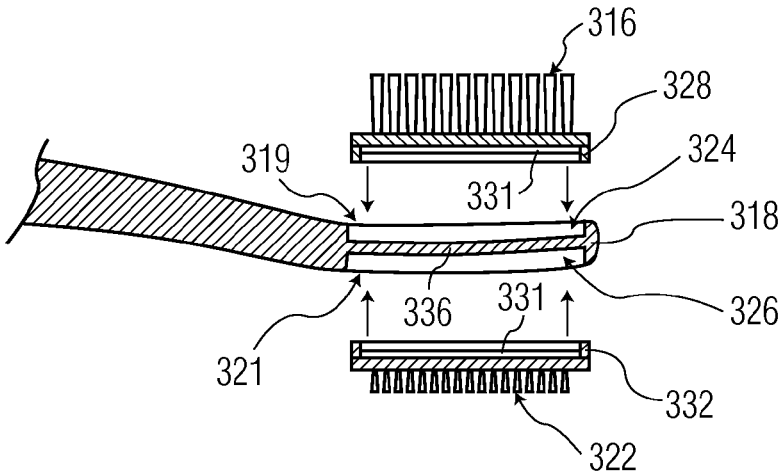
FIG. 8 is an exploded section view of the oral care implement head of FIG. 7 taken along line 8-8 of FIG. 7.

Referring now to FIGS. 7 and 8, a head portion 312 is shown of an oral care implement 310, which generally includes the same aspects and features as oral care implement 110 and head portion 112 except as discussed hereafter. Like numbers in FIGS. 7 and 8 refer to like features of FIGS. 4 and 5. As shown in FIGS. 7 and 8, head platform 318 includes a support rib 336 disposed between first cavity 324 and second cavity 326. Gaps 338 and 340 are formed on each side of support rib 336, which are openings connecting first cavity 324 and second cavity 326. Each of the carrier plates 328 and 332 include a rim 333 and 335 along the portion that is received into its corresponding cavity 324 and 326 of the head platform. Each rim includes a pair of recesses 342 and 344 or 346 and 348, which engage support rib 336 of the head platform when attached thereto.

The configuration of FIGS. 7 and 8 permit opposing carrier plates 328 and 332 to be attached directly to each other. Such a configuration permits head platform 318 to be even thinner than head platform 118. Having a thinner head platform provides the advantage of permitting tooth cleaning elements 316 and/or soft tissue cleaning elements 322 to be longer than in the configuration of FIGS. 4 and 5 while maintaining the overall height of the toothbrush head at height H3 shown in FIG. 3. In addition, directly attaching carrier plates 328 and 332 to each other and to support rib 338 provides the advantages of increased stability and support. Preferably, carrier plates 328 and 332 are ultrasonically welded to each other and to support rib 338. However, other acceptable attachment mechanisms may be utilized.

Figure 9:
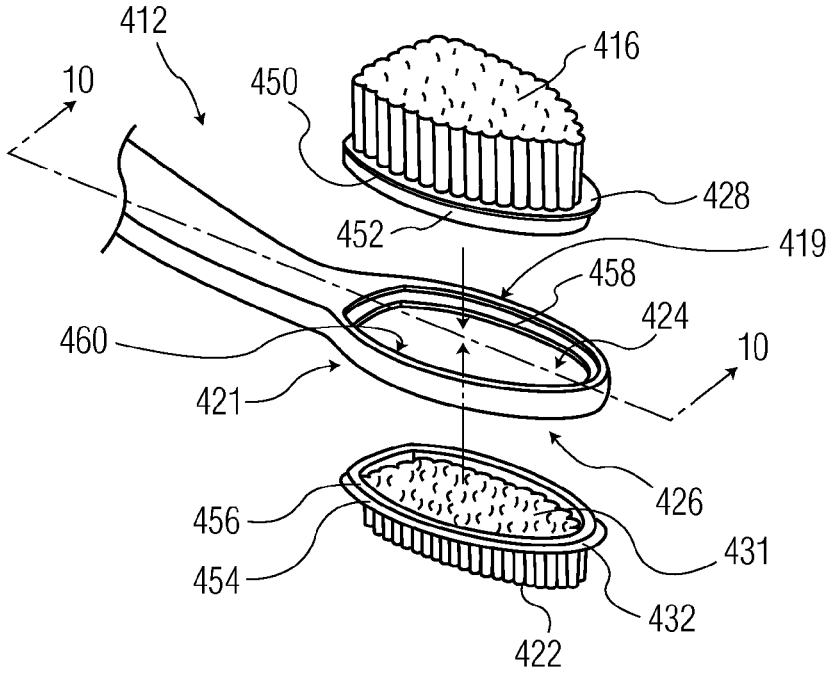
FIG. 9 is an exploded perspective view of an oral care implement head according to one or more aspects of an illustrative embodiment.
Figure 10:
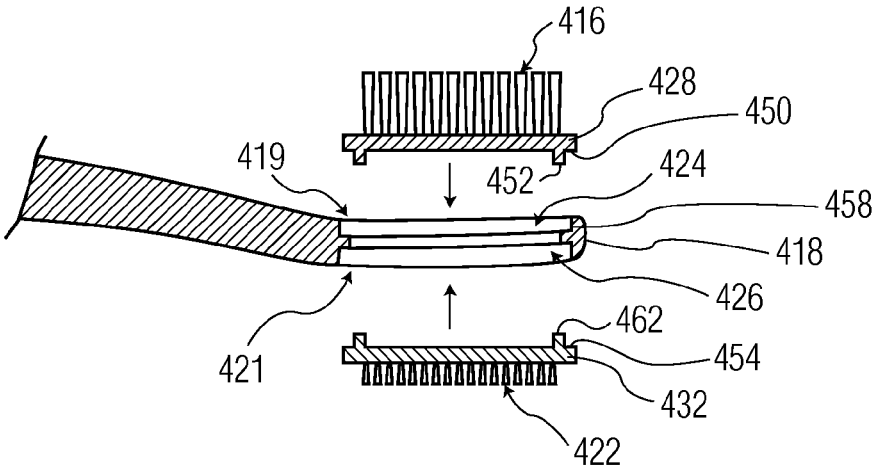
FIG. 10 is an exploded section view of the oral care implement head of FIG. 9 taken along line 10-10 of FIG. 9.

Referring now to FIGS. 9 and 10, a head portion 412 is shown of an oral care implement 410, which generally includes the same aspects and features as oral care implements 110 and 310 and head portions 112 and 312 except as discussed hereafter. Like numbers refer to like features of FIGS. 4 and 5 and 7 and 8. As shown in FIGS. 9 and 10, head platform 418 includes a support ledge 458 disposed between first cavity 424 and second cavity 426. Support ledge 458 outlines an opening 460, which connects first cavity 424 and second cavity 426. Each of the carrier plates 428 and 432 include a rim 452 and 462 along the portion that is received into its corresponding cavity 424 and 426 of the head platform. The rims 452 and 462 are disposed inside of the outer edge of their respective carrier plate to form shoulders 450 and 454. The shoulders and rims of each carrier plate engage support ledge 458 of the head platform when attached thereto.

As with FIGS. 7 and 8, the configuration of FIGS. 9 and 10 permit opposing carrier plates 428 and 432 to be attached directly to each other in an alternative configuration from FIGS. 7 and 8. Such a configuration also permits head platform 418 to be thinner than head platform 118 and provides similar advantages to the configuration of FIGS. 7 and 8. In addition, due to its location proximate the rim regions of each carrier plate, support ledge 458 provides significant support to each of the carrier plates. Preferably, carrier plates 428 and 432 are ultrasonically welded to each other and to support ledge 458. However, other acceptable attachment mechanisms may be utilized.

In an alternative configuration (not shown), the head platform can include both a support ledge 458 and a support rib 338 to securely affix the carrier plates to the head platform while permitting the carrier plates to be attached to each other as well. It is further understood that other configurations may be employed to maintain a relatively thin head platform to which the carrier plates can be affixed while optionally permitting the carrier plates to be affixed to each other.

Figure 11:
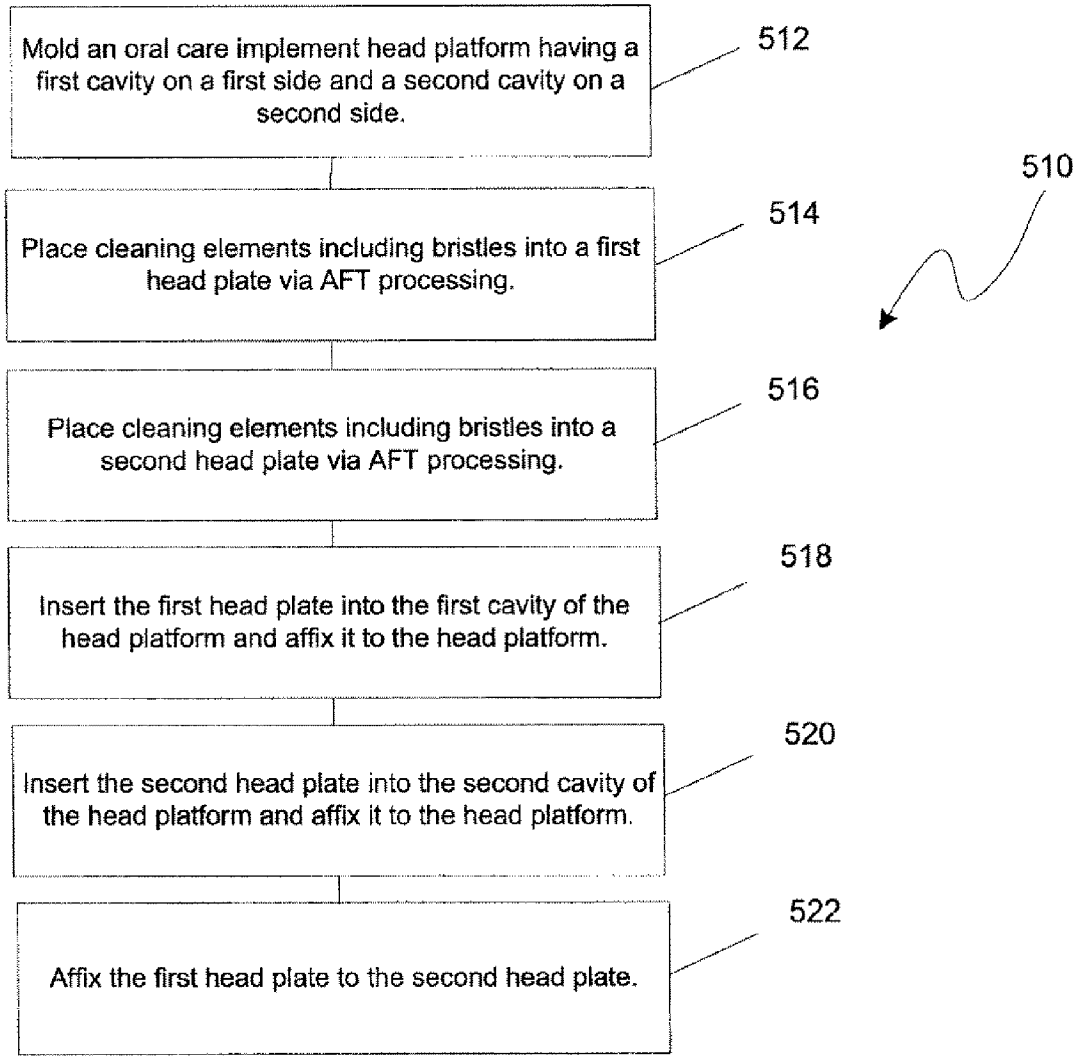
FIG. 11 illustrates a method for forming an oral care implement having a plurality of bristled heads according to one or more aspects of an illustrative embodiment.

FIG. 11 illustrates a method 510 for forming an oral care implement in which the carrier plates can be attached to the head platform and to each other. Method 520 generally includes the same steps and features as method 210, except that it includes the additional step 522 of affixing the first carrier plate to the second carrier plate. Step 522 can be performed along with step 520 when the second carrier plate is affixed to the head platform.

Figure 12:
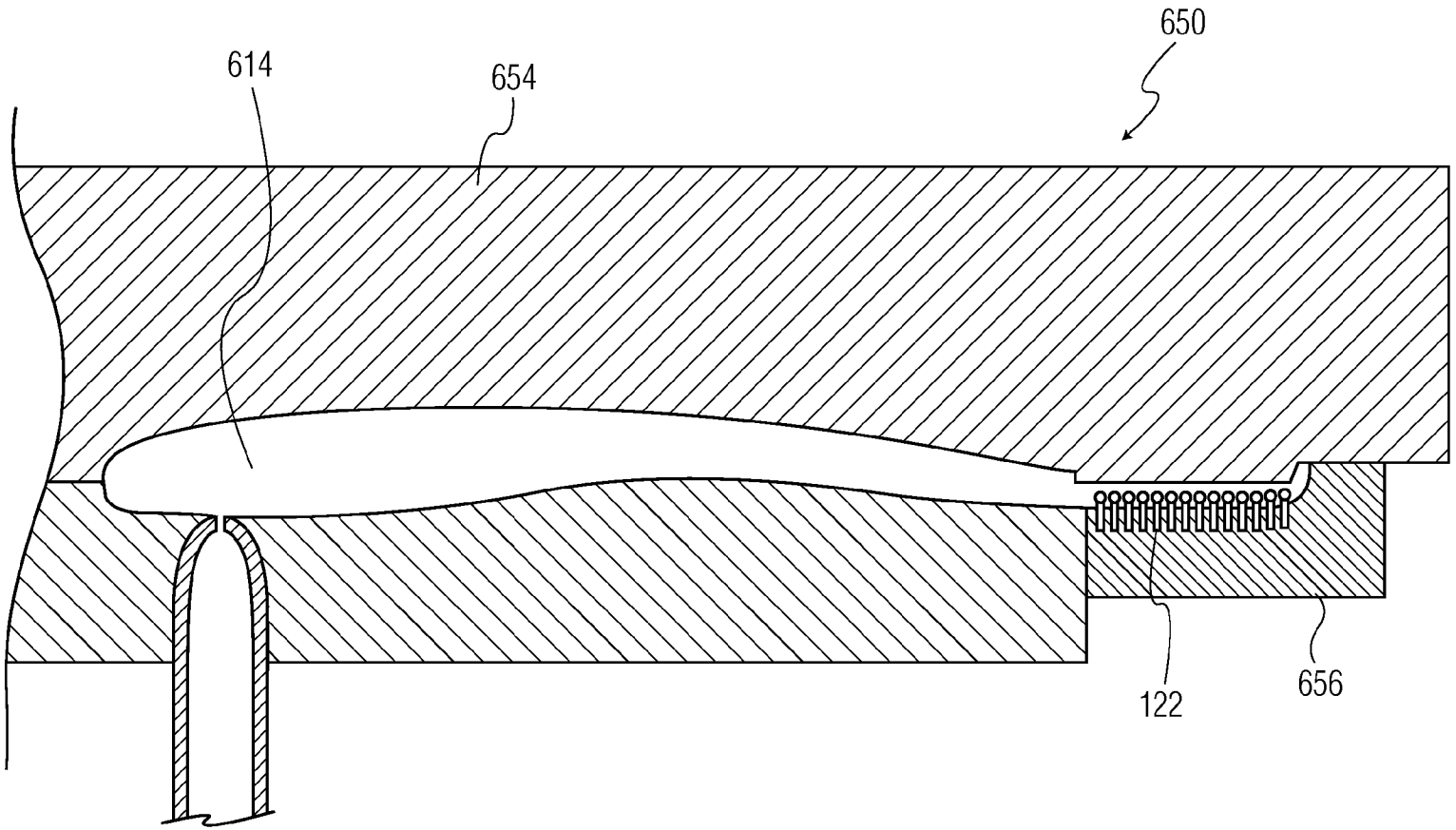
FIG. 12 is cross-sectional view of a mold for injection molding the body of an oral care implement having a plurality of bristled heads according to one or more aspects of an illustrative embodiment.

Referring now to FIG. 12, a mold 650 is shown for forming an oral care implement according to aspects of the invention, such as oral care implement 110 shown in FIG. 3. As opposed to previously discussed configurations of oral care implements, mold 650 is configured to affix soft tissue cleaning elements 122 to head platform 118 via in-mold tufting (IMT) techniques. Further, mold 650 is configured to form a cavity in head platform 118 for receiving a carrier plate, such as carrier plate 128, to which tooth cleaning elements 116 are attached via anchor free tufting (AFT) techniques. Thus, mold is 650 is configured to provide an oral cleaning implement that takes advantage of both AFT and IMT techniques to provide an oral care implement, such as oral care implement 110 shown in FIG. 3.

As shown, mold 650 includes a cavity side 654 of the injection mold, which outlines the front portion of oral care implement 110 including a portion of front face 119. Mold 650 further includes a core side 652, which outlines the rear portion of oral care implement 110 except for rear face 121. An insert block 656 forms the rear face 121 and a tip portion of head platform 118. The insert block includes soft tissue cleaning elements 122 placed in the mold prior to molding the handle and the platform head. The soft tissue cleaning elements 122 include filament bristles having balled ends disposed within the cavity of the mold. During injection molding, the balled ends are molded into the platform head. The tooth cleaning elements 116 can be affixed thereafter as discussed along with FIGS. 4 and 5. Likewise, the tooth cleaning elements 116 could be disposed within the cavity of the mold for injection molding into the platform head, with the soft tissue cleaning elements 122 being affixed thereafter.

Figure 13:
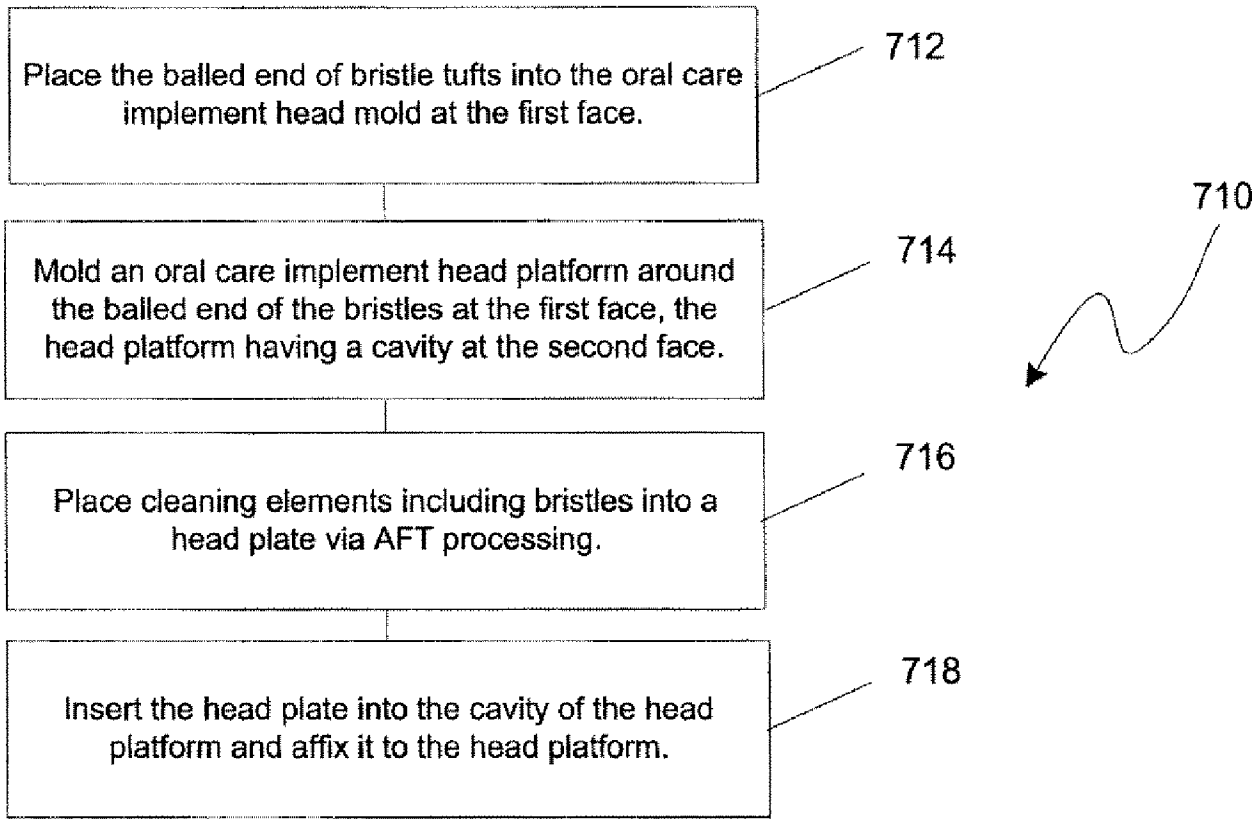
FIG. 13 illustrates a method for forming an oral care implement having a plurality of bristled heads according to one or more aspects of an illustrative embodiment.

Referring now to FIG. 13, a method 710 is shown for forming an oral care implement 110 using mold 650 of FIG. 12. Method 710 includes the step 712 of placing balled end bristle tufts into insert block 656. It further includes the step 714 of molding a platform head 118 around the balled ends of the bristle tufts at a first face 121 of the head platform while forming a cavity at a second face 119 of the head platform. Step 714 may optionally include molding the handle or a portion of the handle at the same time. The method also includes the step 718 of attaching tooth cleaning elements 116 that include bristles onto a head plate via AFT tufting. In addition, the method includes the step 718 of inserting the head plate into the cavity of the head platform and affixing it to the head platform.

Method 710 provides an advantageous method of forming oral care implement 110. Affixing soft tissue cleaning elements 122 via IMT techniques securely attaches the soft tissue cleaning elements to the head platform while permitting the head platform to have a height T of 3 mm to 5 mm. Affixing the tooth cleaning elements 116 via AFT techniques provides design flexibility for the tooth cleaning elements along with securely connecting the tooth cleaning elements to the head platform. In an alternative configuration, the tooth cleaning elements 116 can be affixed via IMT techniques and the soft tissue cleaning elements 122 can be affixed via AFT techniques.

In other embodiments, the first carrier plate 128 with tooth cleaning elements 116 and the second carrier plate 132 with tissue cleaning elements 122 can be inserted into a mold, with a handle subsequently being injection molded about the first and second carrier plates 128, 132.

Figure 14:
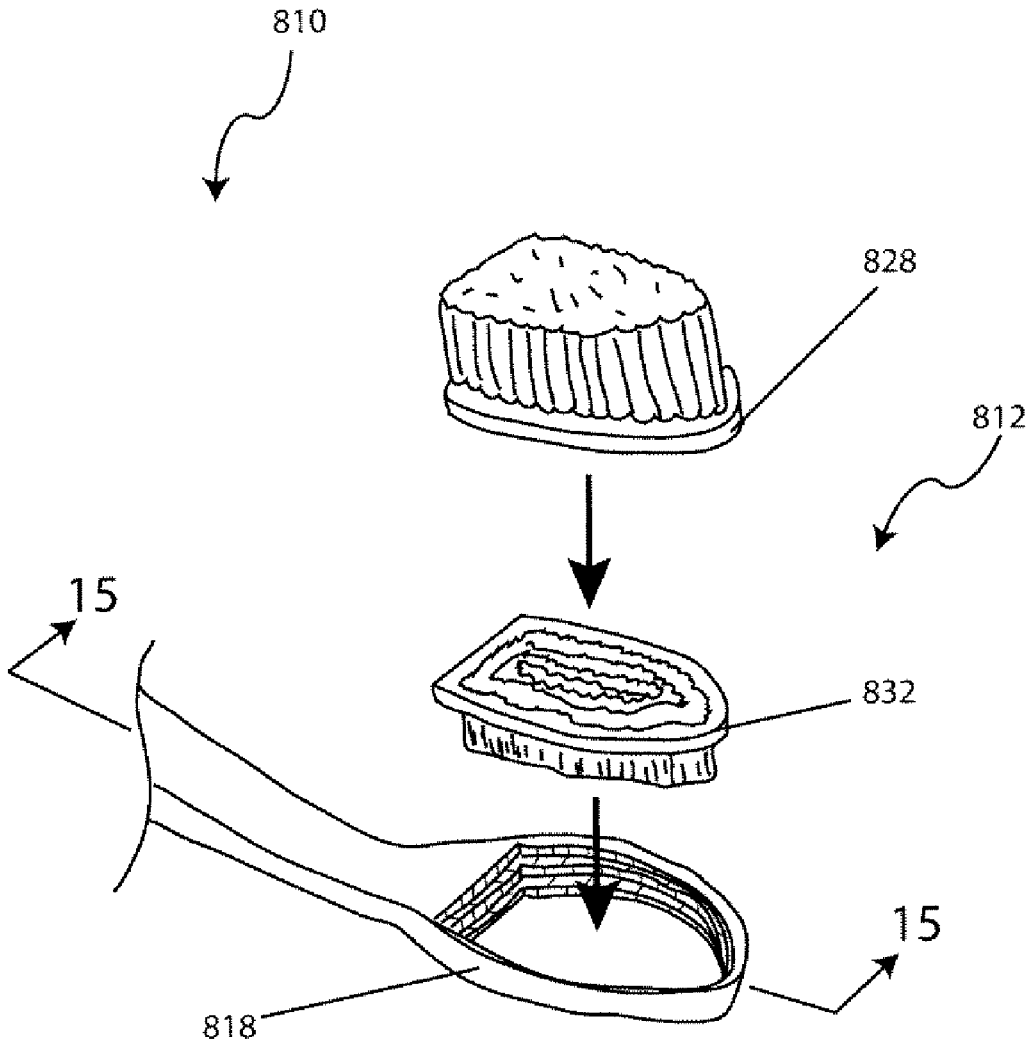
FIG. 14 is an exploded perspective view of another oral care implement head according to one or more aspects of an illustrative embodiment.

Referring now to FIGS. 14-16, a head portion 812 is shown of an oral care implement 810, which generally includes the same aspects and features as oral care implements 110, 310 and 410 and head portions 112, 312 and 412 except as discussed hereafter and shown in FIGS. 14-16. Like numbers generally refer to like features of FIGS. 4-5 and 7-10. As shown in FIG. 15, head platform 818 includes an upper support ledge 858 and a lower support ledge 859 disposed between first cavity 824 and second cavity 826 within opening 860, which includes a channel extending between the cavities. The diameter of upper support ledge 858 is greater than that of lower support ledge 859 to permit second carrier plate 832 to be installed through first cavity 824 and past the upper support ledge for installation on the lower support ledge. Unlike carrier plates 428 and 432 shown in FIGS. 9 and 10, carrier plates 828 and 832 are generally rim-less. However, they could optionally include a rim to assist with connecting to the head platform 818. Carrier plates 828 and 832 each include shoulders 850 and 854 respectively. The shoulder of each carrier plate engages respective upper support ledge 858, 859 of the head platform when attached thereto.

One way that the configuration of FIGS. 14-16 differs from previous configurations is that second carrier plate 832 is located completely within opening 860 below first carrier plate 828 and between the first/front face 819 and the second/rear face 821. As such, cleaning elements 822, such as filament bristles, attached to second carrier plate 832 can extend a greater height H6 from their carrier plate than with other configurations while still having a height H5 from 1 mm to 6 mm extending beyond rear face 821. For instance, if the exposed portion 870 of second carrier plate 832 is recessed 3 mm below rear face 821, then height H6 could be 4 mm to 9 mm while maintaining a desired bristle height H5 of 1 mm to 6 mm for cleaning soft tissues.

The additional length of bristles 821 can provide manufacturing advantages, such as easier retention and handling during processing of the longer bristles than with shorter bristles and reducing the wastage associated with trimming excess bristle length. The additional length can also provide performance advantages. For instance, bristles of greater length H6 can flex more than shorter bristles of height H5 while still extending only height H5 from the rear face. Thus, the thickness of the head can be kept relatively small while providing longer bristles for the soft tissue cleaner on the rear face of the head. Additional advantages can be realized from the configuration of FIGS. 14-16, such as greater retention of second carrier plate 832 by locking it in the head frame 818 via installation of first carrier plate 828 above the second carrier plate.

As with other configurations, the carrier plates can be attached to the head frame via ultrasonic welding, adhesive bonding, mechanical attachment mechanisms, laser welding, etc. However, laser welding may be preferable for the configuration of FIGS. 14-16 due, at least, to the strength of a welded connection and the ease of welding the carrier plates 828 and 832 in the layered configuration of FIGS. 14-16. Laser welding can be performed without the laser apparatus contacting any surface, which can simplify processing. Further, laser equipment can control the laser to follow a complex path, such as shoulders 850 and 854 or support ledges 858 and 859, to provide a comprehensive weld.

Figure 17:
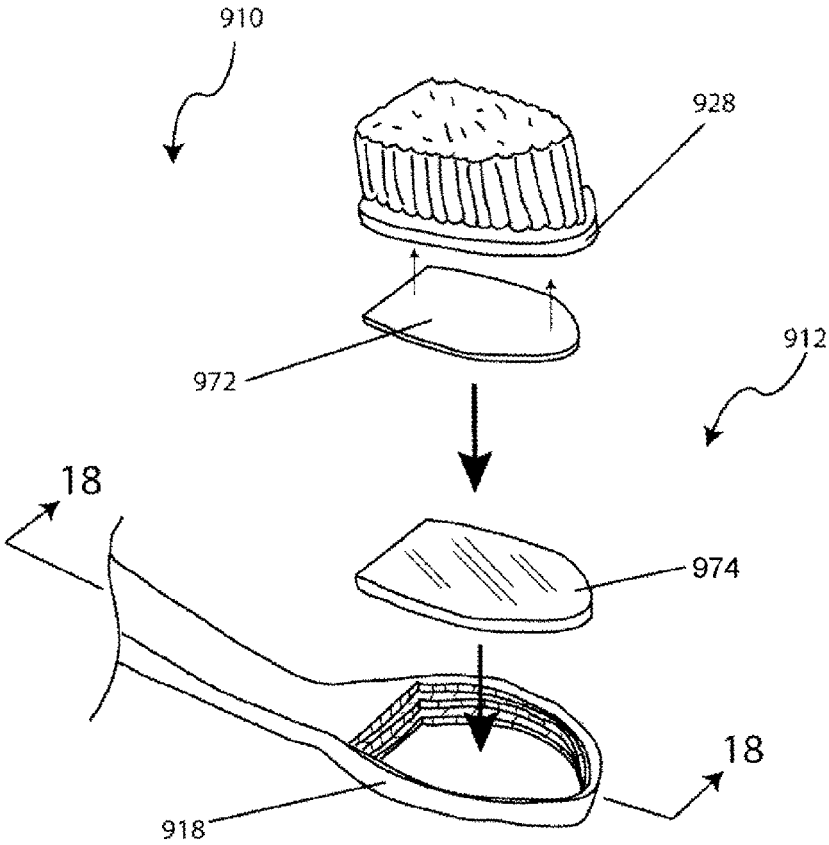
FIG. 17 is an exploded perspective view of a further oral care implement head according to one or more aspects of an illustrative embodiment.

Referring now to FIGS. 17-19, a head portion 912 is shown of an oral care implement 910, which generally includes the same aspects and features as oral care implements 810 and head portions 812 except as discussed hereafter and shown in FIGS. 17-19. Like numbers refer to like features of FIGS. 14-16. As shown in FIGS. 17-19, head platform 918 includes an upper support ledge 958 and a lower support ledge 959 disposed between first cavity 924 and second cavity 926 within opening 960, which includes a channel generally extending between the cavities. In this configuration, a first support member 928, which is shown as a carrier plate 928 for carrying cleaning elements, is attached to a head insert 972 in the form of a backing plate 972. The backing plate can be attached to the underside of the first carrier plate via hot stamping, ultrasonic welding, laser welding, an adhesive connection, a mechanical connection (e.g., snap-fit), etc. As shown in FIG. 18, backing plate 972 could be smaller than the bottom of carrier plate 928 to expose shoulder 950 for attaching the carrier plate directly to head platform 918. Alternatively, backing plate 972 could attach directly to head platform 918 and, thereby, connect carrier plate 928 to the head platform.

Instead of a second support member in the form of a carrier plate, the configuration of FIGS. 17-19 includes a support member in the form of a cover 974 that sandwiches backing plate 972 between itself and first carrier 928. As such, head insert 972 in the form of a backing plate is enclosed within head platform 918. Cover 974 is preferably transparent or translucent to allow the user to view head insert 972. Cover 974 can be made from a plastic material, such as an elastomer, a thermoplastic elastomer or a plastomer. Further, cover 974 could be made from the same or a different material than head platform 918 or first carrier 928. In one configuration, cover 974, first carrier 928 and head platform 918 can be made from polypropylene. Cover 974 includes a front surface 954. When cover 974 is placed within head platform 918, a portion of the front surface 954 may be in surface contact with support ledges 959.

In the configuration shown in FIG. 19, head insert 972 is a reflective material, such as a polished metal plate or a metal foil. Thus, oral care implement 910 can include a mirror on its rear face 921 that is protected from scratches, abrasions, etc. during use by cover 974. FIG. 19 also shows a first carrier 919. In other mirror configurations (not shown), head insert 972 can be attached to cover 974 rather than acting as a backing plate for the first carrier, or it can be attached directly to head platform 918 via an additional support ledge similar to support ledges 958 and 959, or it can simply be retained by being sandwiched between first carrier 928 and cover 974. In further mirror configurations (not shown), insert 972 can be omitted and a reflective coating can be applied to the rear surface 976 of cover 974 or a non-reflective insert can be used that includes a reflective coating on its lower surface 978. Similarly, decorative coatings (e.g., colorful coatings) instead of mirrored coatings can be applied to insert 972 or cover 974. In all of these configurations, the reflective surface or decorative surface is protected from damage, such as scratches, by cover 974.

In other non-mirror configurations, head insert 972 can include decorative features. For instance, head insert 972 can be a component formed via die-cutting, thermoforming/die cutting, injection molding, metal stamping, etc. to have a particular decorative shape. Such shapes can include shapes of cartoon characters or other desirable figures. As illustrated by the various example configurations discussed herein, the general insert configuration discussed along with FIGS. 17-22 provides an advantageous base oral care implement configuration that can easily be modified by changing the insert and/or one or more of the carriers. Thus, numerous oral care implements can be provided that perform various functions and have various features without making significant changes to the base components, such as the handle, head platform, and one or more of the carriers.

FIGS. 20 and 21 illustrate other potential configurations in which head insert 1072 can include a substance to be emitted from oral care device 910, such as a film or gel containing an oral care agent or other type of agent. In such a configuration, head insert 1072 can simply be retained in the head platform 918 by being sandwiched between first carrier 928 and a second carrier 1082. The second carrier can be in the form of a cleaning elements carrier (e.g., second carrier 832 shown in FIG. 15) or a cover, such as cover 974. Cover 1082 can include small holes 1084 to permit the agent to diffuse therethrough. Agents can include flavor and/or odor or aroma agents to emit desirable flavors and/or odors or aromas to the user. Agents can also include oral care agents such as a dentifrice, an oxidizing or whitening agent, a mouthwash, etc. Agents can further include desirable medications, such as an oral antibiotic or other oral medications, such as prescription and non-prescription medications. In alternative configurations (not shown), such as when the primary purpose of the oral care implement is to deliver an agent, the first carrier 92 can be replaced with a permeable cover, such as second carrier 1082, which can be a cleaning elements carrier or a cover. Thus, agent(s) can be dispensed from both faces of the oral care implement.

In alternative configurations (not shown), an insert retention space can be added between one or both of the carriers shown in FIGS. 3-5 and 7-10 by adding thickness to the head support. The carrier(s) proximate the insert retention space can be replaced with a light-permeable (e.g., transparent) cover, such as cover 974, or an air-permeable and/or fluid-permeable support member. As such, an insert, such as inserts 872, 972 and 1072, can be provided within the insert retention space that is added to those configurations.

Figure 22:
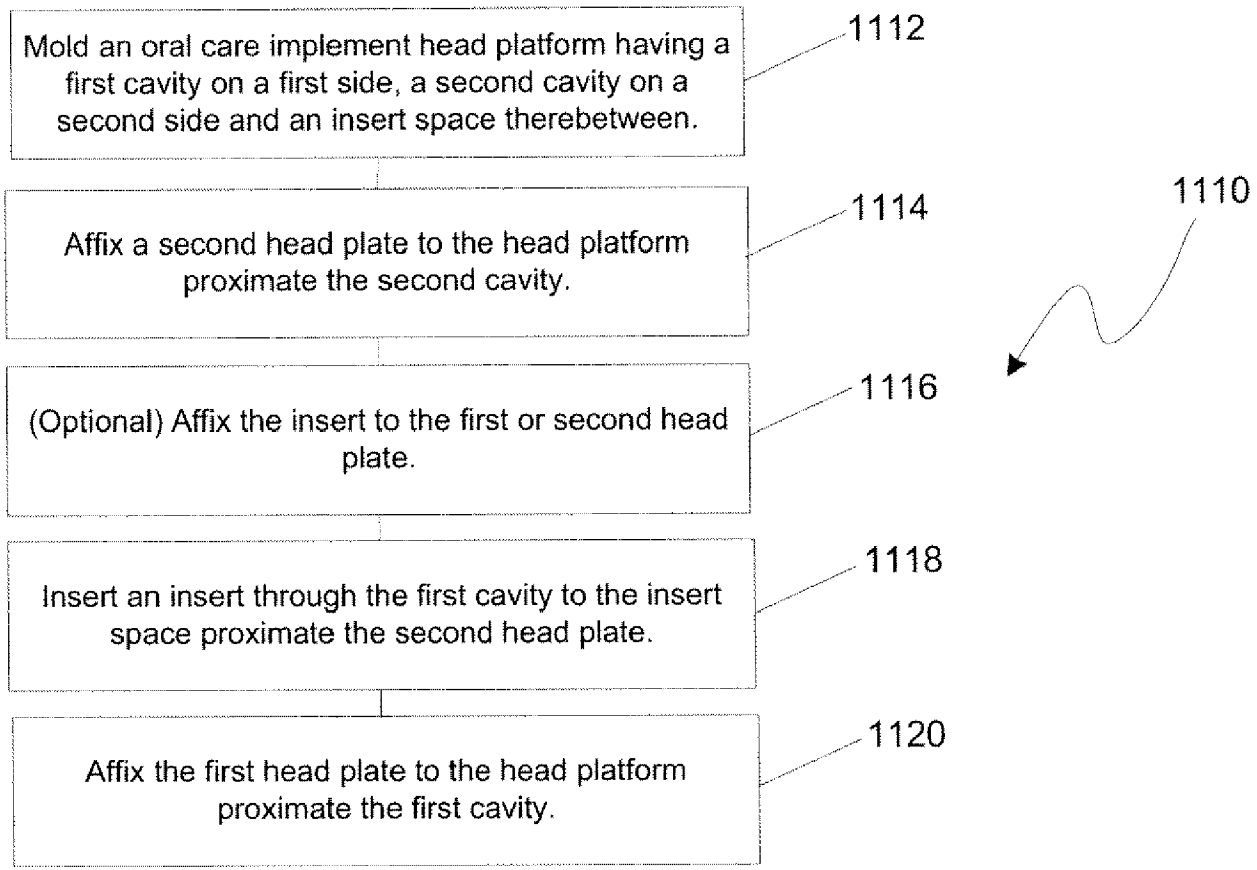
FIG. 22 illustrates a method for forming an oral care implement according to one or more aspects of the disclosed embodiments.

Referring now to FIG. 22 a method 1110 is generally illustrated for forming an oral care implement having a head insert. Method 1110 can include the step 1112 of molding an oral care implement head platform having a first cavity on a first side, a second cavity on a second side and an insert space therebetween and the step 1114 of affixing a second head plate to the head platform proximate the second cavity, such as via ultrasonic welding, adhesive bonding mechanical attachment mechanisms, laser welding, etc. It can optionally include the step 1116 of affixing the insert to the first or second head plate, such as via hot stamping, ultrasonic welding, laser welding, an adhesive connection, a mechanical connection (e.g., snap-fit), etc. It can further include the step 1118 of inserting an insert through the first cavity to an insert space proximate the second head plate and the step 1120 of affixing the first head plate to the head platform proximate the first cavity, such as via ultrasonic welding, adhesive bonding, mechanical attachment mechanisms, laser welding, etc.

While the invention has been described with respect to specific examples including presently preferred modes of carrying out the invention, those skilled in the art will appreciate that there are numerous variations and permutations of the above described systems and techniques. Other aspects, advantages and modifications will be apparent to those skilled in the art to which the invention pertains, and these aspects and modifications are within the scope of the invention and described and claimed herein.

We claim:

1. An oral care implement, comprising:

a handle; and a head comprising:

a head platform having a first cavity formed in a first face thereof, a second cavity formed in a second face thereof, and an insert retention space formed between the first and second faces;

a first plate attached to the head platform proximate the first cavity;

a second plate attached to the head platform proximate the second cavity; and an insert retained in the insert retention space between the first and second plates;

wherein at least one of the first and second plates are air permeable and the insert includes an air-permeable agent;

wherein the second plate includes a translucent or transparent cover permitting the insert to be viewed through the cover by a user, and the insert includes a reflective face oriented toward the translucent or transparent cover.

2. The oral care implement of claim 1, wherein the second plate is recessed from the second face within the head platform and is accessible through the second cavity.

3. The oral care implement of claim 1, wherein the first plate is a carrier plate retaining bristles in an anchor free tufting (AFT) configuration and the insert is a backing plate for the carrier plate.

4. The oral care implement of claim 1, wherein the first and second plates are attached to the head platform via laser welds.

5. The oral care implement of claim 1, wherein the insert is retained via attachment to one of the first and second plates.

6. The oral care implement of claim 1, wherein the insert is retained by being sandwiched between the first and second plates.

7. The oral care implement of claim 1, wherein the air-permeable agent produces aromas.

8. The oral care implement of claim 1, wherein at least one of the first and second plates includes a plurality of bristles extending therefrom.

9. An oral care implement, comprising:

a handle; and a head comprising:

a head platform having a first cavity formed in a first face thereof, a second cavity formed in a second face thereof, and an insert retention space formed between the first and second faces;

a first plate attached to the head platform proximate the first cavity;

a second plate attached to the head platform proximate the second cavity; and an insert retained in the insert retention space between the first and second plates;

wherein the at least one of the first and second plates are fluid permeable and the insert includes a fluid-permeable agent;

wherein the second plate includes a translucent or transparent cover permitting the insert to be viewed through the cover by a user, and the insert includes a reflective face oriented toward the translucent or transparent cover.

10. The oral care implement of claim 9, wherein the fluid-permeable agent includes an oral care agent.

11. The oral care implement of claim 10, wherein the fluid-permeable agent includes a medication.

* * * * *